US012050057B2

(12) United States Patent
Kumar

(10) Patent No.: US 12,050,057 B2
(45) Date of Patent: Jul. 30, 2024

(54) METHOD AND SYSTEM FOR CONTROLLING REFRIGERANT COMPOSITION IN CASE OF GAS TUBE LEAKS IN A HEAT EXCHANGER

(71) Applicant: SHELL OIL COMPANY, Houston, TX (US)

(72) Inventor: Paramasivam Senthil Kumar, Bangalore North (IN)

(73) Assignee: Shell USA, INC., Houston, TX (US)

( * ) Notice: Subject to any disclaimer, the term of this patent is extended or adjusted under 35 U.S.C. 154(b) by 0 days.

(21) Appl. No.: 17/604,497

(22) PCT Filed: Apr. 30, 2020

(86) PCT No.: PCT/EP2020/062041
§ 371 (c)(1),
(2) Date: Oct. 18, 2021

(87) PCT Pub. No.: WO2020/225096
PCT Pub. Date: Nov. 12, 2020

(65) Prior Publication Data

US 2022/0205713 A1 Jun. 30, 2022

(30) Foreign Application Priority Data

May 3, 2019 (IN) ..... 201941017762
Jun. 17, 2019 (EP) ..... 19180474

(51) Int. Cl.
*F25J 1/02* (2006.01)
*F25J 1/00* (2006.01)

(52) U.S. Cl.
CPC ..... *F25J 1/0249* (2013.01); *F25J 1/0022* (2013.01); *F25J 1/0055* (2013.01); *F25J 1/0254* (2013.01); *F25J 1/0216* (2013.01); *F25J 2280/50* (2013.01)

(58) Field of Classification Search
CPC ..... F25J 1/0022; F25J 1/0087; F25J 1/0052; F25J 1/0055; F25J 1/0214; F25J 1/0254;
(Continued)

(56) References Cited

U.S. PATENT DOCUMENTS 3,593,535 A * 7/1971 Gaumer, Jr. ..... F25J 1/025 62/502
5,813,250 A * 9/1998 Ueno ..... F25J 1/0272 62/903

(Continued)

FOREIGN PATENT DOCUMENTS

RU 2060431 C1 5/1996

OTHER PUBLICATIONS

International Search Report and Written Opinion received for PCT Patent Application No. PCT/EP2020/062041, mailed on Aug. 10, 2020, 08 pages.

(Continued)

*Primary Examiner* — Frantz F Jules
*Assistant Examiner* — Webeshet Mengesha
(74) *Attorney, Agent, or Firm* — Shell USA, INC.

(57) ABSTRACT

A heat exchanger unit that comprises a heat exchanger vessel comprising a plurality of process stream conduits to receive the gaseous process stream and discharge a cooled process stream, and a plurality of refrigerant conduits to receive a pre-cooled mixed refrigerant stream and discharge a cooled mixed refrigerant stream; an expansion device to receive the cooled mixed refrigerant stream and discharge a further cooled mixed refrigerant stream, which is connected to a third and/or fourth refrigerant inlets to provide cooling to the process stream conduits and the refrigerant conduits; a refrigerant bleed vessel to receive a first refrigerant split-off stream from the cooled mixed refrigerant stream and a second refrigerant split-off stream from the pre-cooled (Continued)

mixed refrigerant stream; the refrigerant bleed vessel comprising a bleed outlet to discharge a bleed stream and a recycle outlet fluidly connected to the third and/or fourth refrigerant inlets.

17 Claims, 4 Drawing Sheets

(58) Field of Classification Search
CPC ..... F25J 2220/62; F25J 1/0249; F25J 1/0216; F25J 2280/50
See application file for complete search history.

(56) References Cited

U.S. PATENT DOCUMENTS

| | | | | |
|---|---|---|---|---|
| 6,370,910 | B1 | 4/2002 | Grootjans et al. | |
| 6,658,891 | B2 | 12/2003 | Reijnen et al. | |
| 2008/0156037 | A1 | 7/2008 | Van De Graaf | |
| 2009/0301131 | A1 | 12/2009 | Bakker et al. | |
| 2010/0293996 | A1 | 11/2010 | Gijsbert | |
| 2011/0036121 | A1 | 2/2011 | Roberts et al. | |
| 2016/0298898 | A1* | 10/2016 | Ducote, Jr. ..... | F25J 1/0035 |

OTHER PUBLICATIONS

Notice of Allowance Received for Russian Application No. 2021135471, Mailed on Aug. 28, 2023, 12 Pages (12 Pages of Official Copy).

* cited by examiner

METHOD AND SYSTEM FOR CONTROLLING REFRIGERANT COMPOSITION IN CASE OF GAS TUBE LEAKS IN A HEAT EXCHANGER

CROSS REFERENCE TO RELATED APPLICATIONS

This is a National stage application of International application No. PCT/EP2020/062041, filed 30 Apr. 2020, which claims priority of Indian application No. 201941017762, filed 3 May 2019 and European application no. 19180474.9, filed 17 Jun. 2019, all of which are incorporated herein by reference in their entirety.

FIELD OF THE INVENTION

The disclosure relates to liquefaction of gases. Herein, the disclosure is directed at a method and system for controlling the composition of a refrigerant in case of gas tube leaks in a heat exchanger. The gas is for instance natural gas. The heat exchanger is for instance a main cryogenic heat exchanger in a production train for liquefied natural gas. The refrigerant is for instance a mixed refrigerant.

BACKGROUND TO THE INVENTION

Natural gas can be liquefied for purposes of storage and transportation, as the gas occupies a smaller volume as a liquid than in the gaseous state. Liquefaction takes place in a LNG (liquid natural gas) plant, in which a natural gas feed stream is typically first treated (including for instance the removal of contaminants) and subsequently liquefied. The section for liquefaction typically includes one or more heat exchangers to cool the (natural) gas by heat exchange with a refrigerant. Of these heat exchangers, the last heat exchanger for cooling the natural gas to the liquid state is typically referred to as the main cryogenic heat exchanger (MCHE).

Leaks in natural gas tubes in the heat exchanger are a known issue. Such leaks may result not only in a loss of natural gas, but also in a change of the composition of the refrigerant, typically a mixed refrigerant. The leaked natural gas ends up in the refrigerant stream and thus typically disturbs the predetermined and controlled composition of the mixed refrigerant, thereby potentially disturbing the temperature profile across the main cryogenic heat exchanger and thereby affecting the ability to produce LNG at desired rates and efficiency.

Leak management strategies are known in which leaked natural gas is bled from the mixed refrigerant by bleeding lighter components of the mixed refrigerant at selected locations and in which a make-up refrigerant stream is fed to the mixed refrigerant. The make-up refrigerant (typically providing required components such as ethane and/or nitrogen) is obtained from refrigerant make-up sources and/or storage, to ensure the methane content in the refrigerant circuit is maintained within a predetermined range to thereby maintain the predetermined temperature profile across the MCHE. This strategy is applied in the transient period between the formation of leaks in the natural gas tubes and planned or unplanned shutdown of the main cryogenic heat exchanger for maintenance or repair.

However, the resulting continuous bleed and make-up of refrigerant results in a significant collateral loss of refrigerant components, such as ethane and nitrogen. Refrigerant make-up is expensive and often limited by supply constraints. When the supply or production of critical refrigerant components, especially ethane and/or nitrogen, is insufficient to meet demand arising from leak management as well as other routine refrigerant make-up requirements (for instance due to refrigerant loss via compressor seals, ramp-up or down of LNG production requiring inventory adjustment, refrigerant composition optimization, LNG train start-up after a trip or shutdown), shutdown of the MCHE needs to be accelerated. The ability of remotely operated LNG plant to supply refrigerant to LNG train(s) with leaking MCHE(s) from its own refrigerant production unit(s) or import from other sources is limited, especially for liquified ethane.

Natural gas tube leak in MCHEs is a known recurring issue at many sites, resulting in slowdown of the affected train. As the MCHE tube leak rate progresses, it can cause slowdown of the other trains due to refrigerant supply constraints. At this point, an opportunity shutdown of the LNG train is usually conducted to repair the affected MCHE. This problem becomes acute if the feed gas is leaner in refrigerant components, mainly ethane. In the long run, this results in more frequent shutdowns, more down time and hence less production and more costs.

In a conventional LNG facility, for instance, an LNG production facility comprising a significant number of LNG trains (for instance 3 trains of more) and comprising a typical (high pressure) NGL extraction system and processing a reasonably rich feed gas (for instance LNG HHV >1120 Btu/scf), experience has shown that only a single significant MCHE tube leak (significant herein meaning, for instance, an MCHE natural gas leak rate of more than approximaterly 50 tpd [tonne per day]) can be accommodated effectively without causing a slowdown in the other LNG trains. If there is a concurrent MCHE natural gas tube leak in another train, then the demand on ethane exceeds the supply and therefore results in a slowdown (i.e. reduction) in LNG production, with the associated negative impact on revenue. Also, the operational flexibility, especially the ability to shutdown or start-up and ramp-up or down of LNG trains is affected.

Also, as conventional leak management strategies require relatively large amounts of refrigerant make-up, the operational flexibility of the plant is affected, especially the ability to shutdown or start-up and ramp-up or down of an LNG train.

In view of the above, there is demand for a more efficient way of dealing with leaks in the natural gas tubes of a heat exchanger. Such more efficient system and method may minimize ethane and nitrogen demand during leaks in the natural gas circuit of the heat exchanger and thereby increase the LNG train availability and LNG production. The heat exchanger herein may be, for instance, a main cryogenic heat exchanger or a pre-cooling heat exchanger.

SUMMARY OF THE INVENTION

In one aspect the disclosure provides a heat exchanger unit for cooling a gaseous process stream, the heat exchanger unit comprising:

a heat exchanger vessel, the heat exchanger vessel comprising a plurality of process stream conduits arranged to receive the gaseous process stream and discharge a cooled process stream, and a plurality of refrigerant conduits to receive at least part of a pre-cooled mixed refrigerant stream and to discharge at least one cooled mixed refrigerant stream;

at least one expansion device arranged to receive at least part of the cooled mixed refrigerant stream and discharge a further cooled mixed refrigerant stream, the further cooled mixed refrigerant stream being connected to at least one of a third refrigerant inlet and a fourth refrigerant inlet of the heat exchanger vessel to provide cooling to the process stream conduits and the refrigerant conduits;

a refrigerant bleed vessel arranged to receive a first refrigerant split-off stream from the cooled mixed refrigerant stream and to receive a second refrigerant split-off stream from the pre-cooled mixed refrigerant stream;

the refrigerant bleed vessel comprising a bleed outlet to discharge a bleed stream and a recycle outlet to discharge a recycle stream, the recycle outlet being fluidly connected to at least one of the third refrigerant inlet and the fourth refrigerant inlet of the heat exchanger vessel.

In an embodiment, the second refrigerant split off stream is connected to the pre-cooled mixed refrigerant stream upstream of a refrigerant inlet of the plurality of refrigerant conduits.

Another embodiment provides said heat exchanger, the plurality of refrigerant conduits comprising first refrigerant conduits and second refrigerant conduits, the main cryogenic heat exchanger unit comprising a refrigerant separator arranged to receive the pre-cooled mixed refrigerant stream and to provide a pre-cooled heavy mixed refrigerant stream and a pre-cooled light mixed refrigerant stream, the first refrigerant conduits being fluidly connected to a first outlet of the separator to receive the pre-cooled heavy mixed refrigerant stream and to provide a cooled heavy mixed refrigerant stream, and the second refrigerant conduits being fluidly connected to a second outlet of the refrigerant separator to receive the pre-cooled light mixed refrigerant stream and to provide a cooled light mixed refrigerant stream.

In an embodiment, the second refrigerant split-off stream is connected to the refrigerant loop downstream of the refrigerant separator.

In yet another embodiment, the second split-off stream is connected to the refrigerant loop upstream of the heat exchanger vessel.

Optionally, the second refrigerant split off stream originates from an intermediate section of the second refrigerant conduits.

In an embodiment, the first split-off stream is connected to the cooled heavy mixed refrigerant stream.

In another embodiment, the heat exhanger unit comprises a first control valve to control a mass flow rate of the first refrigerant split-off stream, and/or a second control valve to control a mass flow rate of the second refrigerant split-off stream.

In an embodiment, the heat exhanger unit comprises a third control valve to control one or more of pressure in the refrigerant bleed vessel and/or mass flow rate of the bleed stream.

Optionally, the heat exhanger unit comprises a fourth control valve to control mass flow rate of the recycle stream.

According to another aspect, the disclosure provides method for cooling a gaseous process stream, the method comprising the steps of:

providing a heat exchanger vessel, the heat exchanger vessel comprising a plurality of process stream conduits, a plurality of refrigerant conduits, a third refrigerant inlet and a fourth refrigerant inlet;

receiving the gaseous process stream in the process stream conduits and discharging a cooled process stream from the process stream conduits, receiving at least part of a pre-cooled mixed refrigerant stream in the plurality of refrigerant conduits and discharging at least one cooled mixed refrigerant stream from the plurality of refrigerant conduits;

receiving at least one of the at least one cooled mixed refrigerant stream at at least one expansion device the at least one expansion device discharging at least one further cooled mixed refrigerant stream, providing the at least one further cooled mixed refrigerant stream to at least one of a third refrigerant inlet and a fourth refrigerant inlet of the heat exchanger vessel to provide cooling to the process stream conduits and to the refrigerant conduits;

receiving a first refrigerant split-off stream from the cooled mixed refrigerant stream in a refrigerant bleed vessel, receiving a second refrigerant split-off stream from the pre-cooled mixed refrigerant stream in the refrigerant bleed vessel;

discharging a bleed stream from a bleed outlet of the refrigerant bleed vessel; and discharing a recycle stream from a recycle outlet of the refrigerant bleed vessel, the recycle outlet being fluidly connected to at least one of the third refrigerant inlet and the fourth refrigerant inlet of the heat exchanger vessel.

In an embodiment, the step of receiving a second refrigerant split-off stream from the pre-cooled mixed refrigerant stream in the refrigerant bleed vessel comprises:

mixing the second refrigerant split-off stream from the pre-cooled mixed refrigerant stream with the first refrigerant split-off stream; and providing the mixture of the first refrigerant split-off stream and the second refrigerant split-off stream to the refrigerant bleed vessel.

The method may comprise:

separating the pre-cooled mixed refrigerant stream into a pre-cooled heavy mixed refrigerant stream and a pre-cooled light mixed refrigerant stream, the step of receiving at least part of a pre-cooled mixed refrigerant stream in the plurality of refrigerant conduits comprising:

receiving the pre-cooled heavy mixed refrigerant stream in first refrigerant conduits and discharging a cooled heavy mixed refrigerant stream, receiving the pre-cooled light mixed refrigerant stream in second refrigerant conduits and discharging a cooled light mixed refrigerant stream.

In an embodiment, the method comprises the step of obtaining the first refrigerant split-off stream from the cooled heavy mixed refrigerant stream.

The method may comprise the step of obtaining the second refrigerant split-off stream from the pre-cooled heavy mixed refrigerant stream.

Optionally, the method comprises the step of controlling a temperature and/or pressure of the first refrigerant split-off stream by adjusting a second flow rate of the second refrigerant split-off stream relative to a first flow rate of the first refrigerant split-off stream.

In yet another embodiment, the bleed stream is a vapor stream, the method comprising the step of at least partially condensing the bleed stream using a condensing medium.

The method may comprise the step of separating a condensing stream from the cooled light refrigerant stream and using the condensing stream as the condensing medium.

The system and method of the present disclosure allow a significantly reduced requirement for refrigerant make up in case of a methane leak in the gas circuit of a heat exchanger. The requirement may be reduced up to a factor 2 or 3 with respect to a conventional system. The system and method allow a bleed stream with increased selectivity for methane. Selectivity for methane may exceed 80% or more. The system and method of the invention allow to keep the add-on kit relatively small, compared to conventional systems. The system and method may achieve this by only using a slip steam of the refrigerant. The latter enables to arrange the equipment for refrigerant composition control on a mobile skid. Such skid also allows to apply the same skid mounted kit for separate LNG trains. In other words, a single skid mounted system can be used to manage the refrigerant composition of two or more LNG trains. This also enables to minimize requirements for hydrocarbon inventory for refrigerant make-up and therefore to minimize the associated safety risks.

BRIEF DESCRIPTION OF THE DRAWINGS

The drawing figures depict one or more implementations in accord with the present teachings, by way of example only, not by way of limitation. In the figures, like reference numerals refer to the same or similar elements. Herein, FIG. 1 schematically depicts an embodiment of a main cryogenic heat exchanger according to the present disclosure.

DETAILED DESCRIPTION OF THE INVENTION

Certain terms used herein are defined as follows:

"NG" refers to natural gas. Natural gas is a naturally occurring hydrocarbon gas mixture primarily comprising methane, but commonly including varying amounts of other higher alkanes, and sometimes a small percentage of carbon dioxide, nitrogen, hydrogen sulfide, or helium;

"LNG" refers to liquefied natural gas, which is typically cooled to at least a temperature whereat the gas can be in the liquid phase at about 1 bar pressure; for liquefied methane this temperature is about −162° C.;

"Mixed refrigerant" or "MR" refers to a refrigerant comprised of two or more components. Depending on the stage of the heat exchanger (pre-cooler or main cryogenic heat exchanger), the refrigerant may include components such as methane, ethane, propane, and nitrogen.

"HMR" and "LMR" refer to "heavy mixed refrigerant" and "light mixed refrigerant" respectively, indicating mixed refrigerant separated into light and heavy mixed refrigerant streams, wherein the terms "light" and "heavy" indicate average component weight of each stream relative to each other;

"Bar" is a metric unit of pressure, defined as equal to 100 kPa. "Bar(a)" and "bara" are sometimes used to indicate absolute pressures and "bar(g)" and "barg" for gauge pressures. Herein, "2 barg" is similar to fuller descriptions such as "gauge pressure of 2 bar" or "2-bar gauge".

Different liquefaction schemes are known, such as C3MR, SMR (single mixed refrigerant) or DMR (double mixed refrigerant). Many of these schemes comprise a coil wound heat exchanger, typically the main cryogenic heat exchanger, in which a substantial part of the cooling of the natural gas takes place. Suitable coil wound heat exchangers are commercially available from a variety of vendors, including Air Products and Chemicals Inc. (APCI), Pennsylvania (USA), and Linde AG (Germany)

Figure 1:
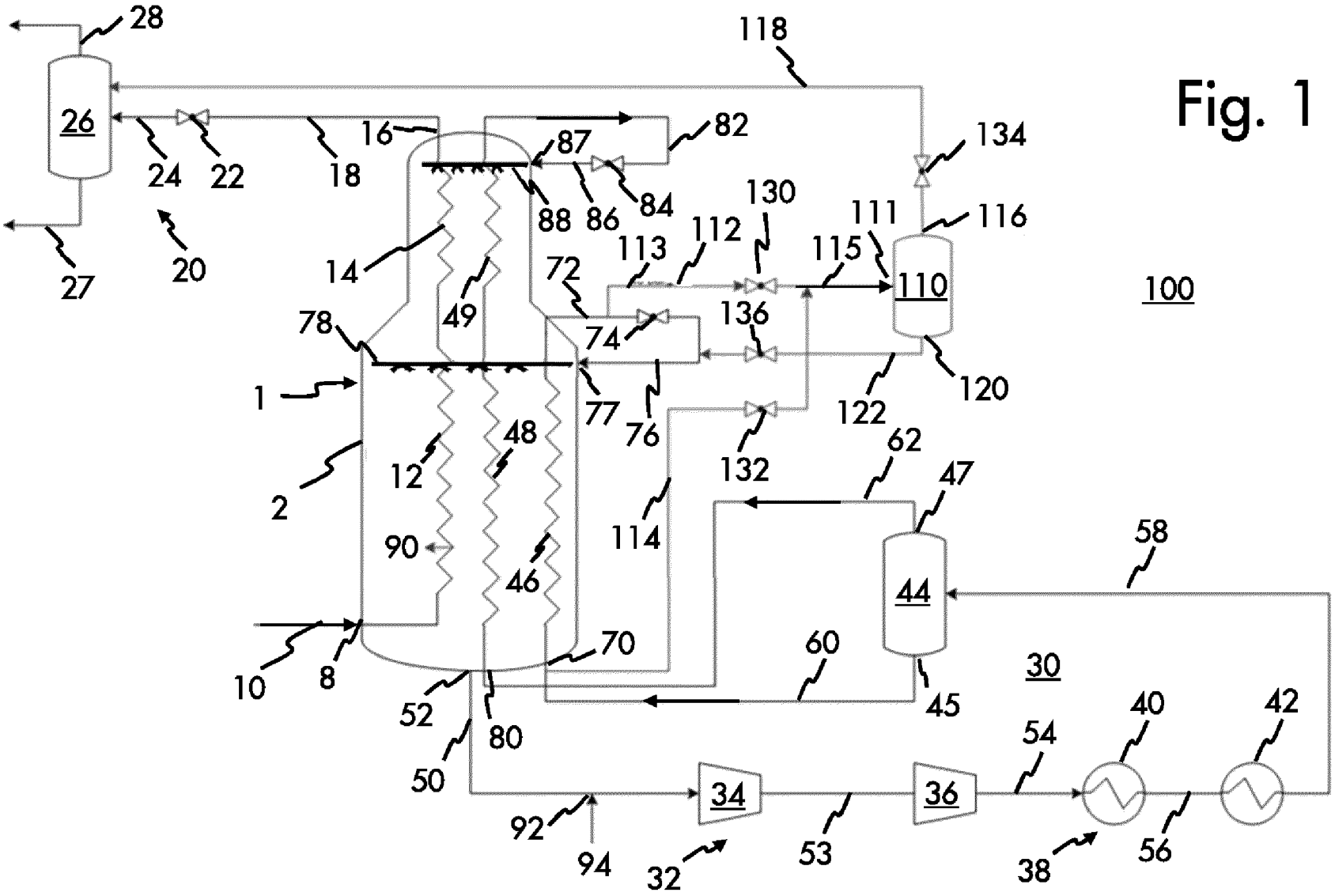

FIG. 1 schematically depicts an embodiment of a (main cryogenic) heat exchanger unit 100. The main cryogenic heat exchanger unit comprises a heat exchanger vessel 2. The main cryogenic heat exchanger vessel 2 defines an internal space, referred to as the shell side. A plurality of tubes for transporting fluids are arranged inside the vessel 2.

The heat exchanger vessel 2 may comprise a first inlet 8, or first gas inlet 8, arranged to receive a natural gas feed stream 10. The natural gas feed stream 10 may have been pre-treated. Pre-treatment herein may include one or more of removing water, removing contaminants, removing heavies (hydrocarbon components heavier than methane), and pre-cooling by a pre-cooling stage. The pre-cooling stage may include a propane pre-cooling stage. The natural gas feed stream 10 may be provided to a plurality of (typically coil wound) natural gas conduits or tubes 12, 14 (schematically depicted as a single line).

The main cryogenic heat exchanger vessel 2 further comprises a first outlet 16 to, in use, discharge a cooled natural gas stream 18 collected from the plurality of natural gas tubes 12, 14. The cooled natural gas stream 18 may be a (partially or fully) liquefied natural gas stream or may be a gaseous stream. In general, the cooled NG stream 18 is fully liquefied. Herein, please note that at elevated pressure, in the order of 45 to 55 barg, the natural gas turns liquid at temperatures as high as −70 to −85° C. Stream 18 may be passed to a further cooling stage, such as an end-flash unit and/or a nitrogen removal unit. The end flash unit 20 may comprise flash valve or expander 22, to provide expanded and cooled stream 24. A pressure drop across the valve or expander 22 may result in a temperature reduction, while reducing the pressure to the order of 1 to 2 barg. Stream 24 may be provided to a flash vessel 26 to remove gaseous components. The flash vessel provides liquefied gas stream 27 and gaseous stream 28.

The heat exchanger unit 100 may comprise a refrigerant cycle 30. The refrigerant cycle 30 cycles a refrigerant, typically a mixed refrigerant. The refrigerant cycle 30 is intended to cool the natural gas feed stream in the tubes 12, 14 by exchanging heat.

The mixed refrigerant cycle 30 may comprise a compressor unit 32. The compressor unit 32 may comprise one, two or more (intercooled) compressors 34, 36 in series. An outlet of the compressor unit 32 may be connected to a refrigerant heat exchanger unit 38, comprising one or more heat exchangers 40, 42. An outlet of the refrigerant heat exchanger unit 38 may be connected to a separator 44. A lower outlet 45 of the separator 44 is connected to first refrigerant tubes 46 in the heat exchanger vessel 2. A top outlet 47 of the separator 44 is connected to second refrigerant tubes 48, 49 in the heat exchanger vessel 2.

The compressor unit 32 is adapted for receiving a mixed refrigerant stream 50 from a second outlet 52 of the heat exchanger vessel 2. In use, the compressor unit 32 receives the mixed refrigerant stream 50, compresses the mixed refrigerant, and generates a compressed mixed refrigerant stream 54. The compressed mixed refrigerant stream 54 is at a second pressure, exceeding a first pressure of the mixed refrigerant stream 50. If the compressor unit 32 includes two or more compressors or compressor stages, there will be an intermediate compressed refrigerant stream 53 at an intermediate pressure, between the first pressure and the second pressure. The compressed mixed refrigerant stream 54 may be pre-cooled in pre-cooling refrigerant heat exchanger unit 38 (schematically depicted including two heat exchangers 40, 42 in series) thereby obtaining a pre-cooled mixed refrigerant stream 58.

The compressed mixed refrigerant stream 54 may for instance be pre-cooled in the pre-cooling refrigerant heat exchanger unit 38 against a stream of ambient air or water. Alternatively, the compressed mixed refrigerant stream 54 may be pre-cooled in the pre-cooling refrigerant heat exchanger unit 38 agains a (mixed or single) refrigerant which is used in a pre-cooling stage (not shown) to pre-cool the natural gas feed stream 10 before providing stream 10 to the main cryogenic heat exchanger 1.

Subsequently, the pre-cooled mixed refrigerant stream 58 is passed to the separator 44. The separator provides a pre-cooled heavy mixed refrigerant stream 60 (HMR) in liquid phase via the lower separator outlet 45. The separator 44 also provides a pre-cooled light mixed refrigerant stream 62 (LMR) in vapour phase via the top separator outlet 47.

The pre-cooled heavy mixed refrigerant stream 60 is passed via first refrigerant inlet 70 to the first (coil wound) refrigerant tubes or conduits 46 inside the heat exchanger vessel 2 to be cooled. For clarity, only a single tube 46 of a plurality of tubes is schematically shown. The first refrigerant tubes 46, 47 provide a cooled heavy mixed refrigerant stream 72. The cooled heavy mixed refrigerant stream 72 is passed through a (Joule-Thomson) valve or expander 74 to obtain a further cooled heavy mixed refrigerant stream 76. The further cooled heavy mixed refrigerant stream 76 is provided to third refrigerant inlet 77 of the heat exchanger vessel 2. The further cooled heavy mixed refrigerant stream 76 may be sprayed into the shell side of the heat exchanger vessel 2 or otherwise guided to a predetermined conduit or flow path via first distributor 78.

The light mixed refrigerant stream 62 is passed, via second refrigerant inlet 80, to the second coil wound refrigerant tubes or conduits 48, 49 to be cooled, for obtaining a cooled light mixed refrigerant stream 82. The cooled light mixed refrigerant stream 82 is passed through a (Joule-Thomson) valve or expander 84 to obtain a further cooled light mixed refrigerant stream 86. The further cooled light mixed refrigerant stream 86 is provided to fourth refrigerant inlet 87 of the vessel 2. The further cooled light mixed refrigerant stream 86 may be sprayed into the shell side of the heat exchanger vessel 2 or otherwise guided to a predetermined conduit or flow path via second distributor 88.

The first distributor 78 and second distributor 88 are indicated schematically only. The distributors may comprise any suitable system for guiding the respective refrigerant streams towards predetermined flow paths for cooling the respective conduits for hydrocarbons 12, 14 and/or the conduits for refrigerant 46, 48, 49. Such system may comprise, but is not limited to, a spray header, fluid distributor, flow header, etc. The selection of distributor system is typically vendor specific, wherein vendors typically include Air Products and Chemicals Inc. (USA), and Linde A.G. (Germany).

The heavy mixed refrigerant stream 60 is guided upward through the vessel 2. The cooled heavy mixed refrigerant stream 72 is obtained from the main cryogenic heat exchanger vessel 2 at a top end of the heat exchanger tubes 46. The further cooled heavy mixed refrigerant stream 78 is passed back into the main cryogenic heat exchanger vessel 2 at a first vertical level, typically near or just below said top end of heat exchanger tubes 46.

The light mixed refrigerant stream 62 is guided upwards through the vessel 2 via the heat exchanger tubes 48, 49. The cooled light mixed refrigerant stream 82 is obtained from the main cryogenic heat exchanger vessel 2 near a top end of the heat exchanger tubes 49. The further cooled light mixed refrigerant stream 86 is passed back into the main cryogenic heat exchanger vessel 2 at a second vertical level, typically near or just below said top end of heat exchanger tubes 49.

The first vertical level is gravitationally below the second vertical level. The first vertical level may be halfway the height of the heat exchanger vessel 2 and may be referred to as a mid-position. The second vertical level is above the first vertical level, preferably at or near the top end of the main cryogenic heat exchanger vessel 2. The second vertical level may be referred to as top-position.

The first and second distributors 78, 88 are positioned inside the main cryogenic heat exchanger vessel 2 to spray the further cooled heavy and light mixed refrigerant streams 76, 86 into the shell side of the vessel 2, to provide cooling duty to the plurality of natural gas tubes 12 and to the first and second plurality of refrigerant tubes 46, 48, 49. The further cooled heavy and light mixed refrigerant streams 76, 86 will flow in a substantially downward direction through the shell side of the main cryogenic heat exchanger vessel 2 and will typically (at least partially) evaporate along the way.

At the bottom of the main cryogenic heat exchanger vessel 2, the (at least partially, and preferably fully) vaporized light and heavy mixed refrigerant stream are collected in combination via vessel outlet 52, thereby obtaining the (at least partially vaporized, and preferably fully vaporized) mixed refrigerant stream 50, which is passed to the compressor unit 32.

As described in the introduction, during use of the heat exchanger unit 100, one or more of the gas tubes 12, 14 may start to leak. A gas leak is schematically indicated by arrow 90. The leak 90 is indicated at a certain vertical level within the vessel 2, and FIG. 1 shows a single arrow 90 only. However, the arrow 90 as shown and as referenced herein is intended to represent a combined gas leak of the gas tubes 12, 14. The leak itself may be a single leak, or multiple gas leaks. Each gas leak may be at any vertical level within the vessel 2. The combined gas leak 90 has a certain gas leak rate. The refrigerant circuit 30 comprises a make-up inlet 92 to allow adding a refrigerant make-up stream 94 to the refrigerant in the refrigerant circuit 30. Said make-up inlet 94 may be at any location. In a practical embodiment, the inlet 92 is located between the refrigerant outlet 52 of the vessel and the compressor unit 32. A composition of the refrigerant make-up stream 94 may be adjusted to compensate for the gas typically methane added to the refrigerant stream 50 due to the gas leak 90.

In an embodiment, the heat exchanger unit comprises a refrigerant bleed vessel 110. The bleed vessel 110 has an inlet 111 to receive a first refrigerant split-off stream 112. In an embodiment, the first refrigerant split-off stream 112 is a refrigerant bleed stream. The first refrigerant split-off stream 112 may originate from the cooled mixed refrigerant stream. Herein, the cooled mixed refrigerant stream may refer to the cooled heavy mixed refrigerant stream 72 and/or to the cooled light mixed refrigerant stream 82.

The bleed vessel 110 may also be arranged to receive a second refrigerant split-off stream 114. The second refrigerant split-off stream 114 is a regulating stream to regulate or adjust the temperature and/or pressure of the first refrigerant split-off stream 112. Herein, the second refrigerant split-off stream 114 may be mixed with the first refrigerant split-off stream 112 before the refrigerant inlet 111 of the bleed vessel 110, providing a mixed refrigerant split-off stream 115.

The second refrigerant split-off stream 114 may originate from a warmer section of the refrigerant circuit 30, i.e. upstream of the cooled heavy or light mixed refrigerant stream 72, 82. The second refrigerant split-off stream 114 may originate from a location of choice along the refrigerant loop 30. The second refrigerant split off stream 114 may originate from the pre-cooled mixed refrigerant stream before the inlet 70, 80 of the plurality of refrigerant tubes 46, 48. The second split-off stream 114 may be connected to the refrigerant loop 30 downstream of the pre-cooling mixed refrigerant heat exchanger unit 38. The second split-off stream 114 may be connected to the refrigerant loop 30 downstream of the separator 44. The second split-off stream 114 may be connected to the refrigerant loop 30 upstream of the heat exchanger vessel 2. Said location can be located between the separator 44 and one or both of the refrigerant tubes 46, 48, 49 near the mid-section of the vessel 2.

The refrigerant bleed vessel 110 comprises a bleed outlet 116 to discharge a bleed stream 118 and a recycle outlet 120 to discharge a recycle stream 122. The recycle outlet is fluidly connected to at least one of the distributors 78, 88. As the heat exchanger unit 1 typically is a proprietary vendor package, it is preferred to fluidly connect to a refrigerant inlet of the vessel 2, said refrigerant inlet being connected to the distributor or similar device for guiding the refrigerant stream to the appropriate conduits inside the heat exchanger vessel 2.

The heat exhanger unit 100 may comprise first control valve 130 to control a mass flow rate of the first split-off stream 112 and/or a second control valve 132 to control the flow rate of the second split-off stream 114. The heat exhanger unit 100 may comprise third control valve 134 to control the mass flow rate of the bleed stream 118 and/or to control the pressure in the bleed vessel 110.

The heat exhanger unit 100 may comprise fourth control valve 136 to control the flow rate of the recycle stream 122 and/or to control the liquid level in the bleed vessel 110. The first to fouth control valves can also function to control ratios of flow, such as the ratio of the first split-off stream 112 with respect to the second split-off stream 114.

In a first embodment (FIG. 1), the first refrigerant split off stream 112 comprises a heavey mixed refrigerant stream 113, originating from the cooled heavy mixed refrigerant stream 72. In a practical embodiment, the second refrigerant split-off stream 114 is obtained from the pre-cooled heavy mixed refrigerant stream 60. Herein, the second split-off stream 114 is connected to the pre-cooled heavy mixed refrigerant stream 60 between the HMR outlet 45 of the separator 44 and the HMR inlet 70 of the heat exchanger vessel 2. The bleed stream 118 provided by the separator may be a vapour stream. The bleed stream can be provided to the flash vessel 26 for recovery of methane or to a nitrogen stripper (not shown), or disposed of to a safe system such as a flare.

Additional possibilities exist to minimize bleed rate, i.e. the flow rate of bleed stream 118 Minimizing bleed rate may be beneficial if, for instance, the LNG site is nitrogen constrained instead of or in addition to being ethane constrained.

In a second embodment (FIG. 2), the vapour stream (the bleed stream 118) from the bleed separator 110 can be at least partially condensed using a suitable medium. For instance, condensing stream 150 may be split-off from a suitable location of the refrigerant circuit. In a practical embodiment, the condensing stream 150 originates from the cooled light refrigerant stream 82. The medium for condensing in this case is the light mixed refrigerant. The condensing stream 150 is provided to cold side 154 of a condenser or heat exchange section 156. The condenser section 156 may be arranged on top of the bleed vessel 110. Valve 152 may allow control of flow rate of the condensing stream 150. The condenser section may optionally comprise a tray or packed section 158 for collecting condensed fluids from the bleed stream. After cooling and condensing the bleed stream 118, warmed condensing stream 160 is returned to the refrigerant circuit, for instance by introducing the warmed condensing stream 160 into the further cooled light refrigerant stream 86.

A third embodiment (FIG. 3) allows to minimize bleed rate and to minimize loss of nitrogen. Herein, a liquid LMR bleed stream 142 can be used as first refrigerant split-off stream 112. In this case, first refrigerant split-off stream 112 connects the cooled light refrigerant stream 82 to the separator 110. A nitrogen rich vapour stream can be used as recycle stream 122. Said nitrogen rich vapour stream can be returned back to the shell of the main cryogenic heat exchanger vessel 2. A methane rich liquid stream can be used as bleed stream 118 and can be routed to the end flash vessel 26 for recovery as LNG.

Figure 3:
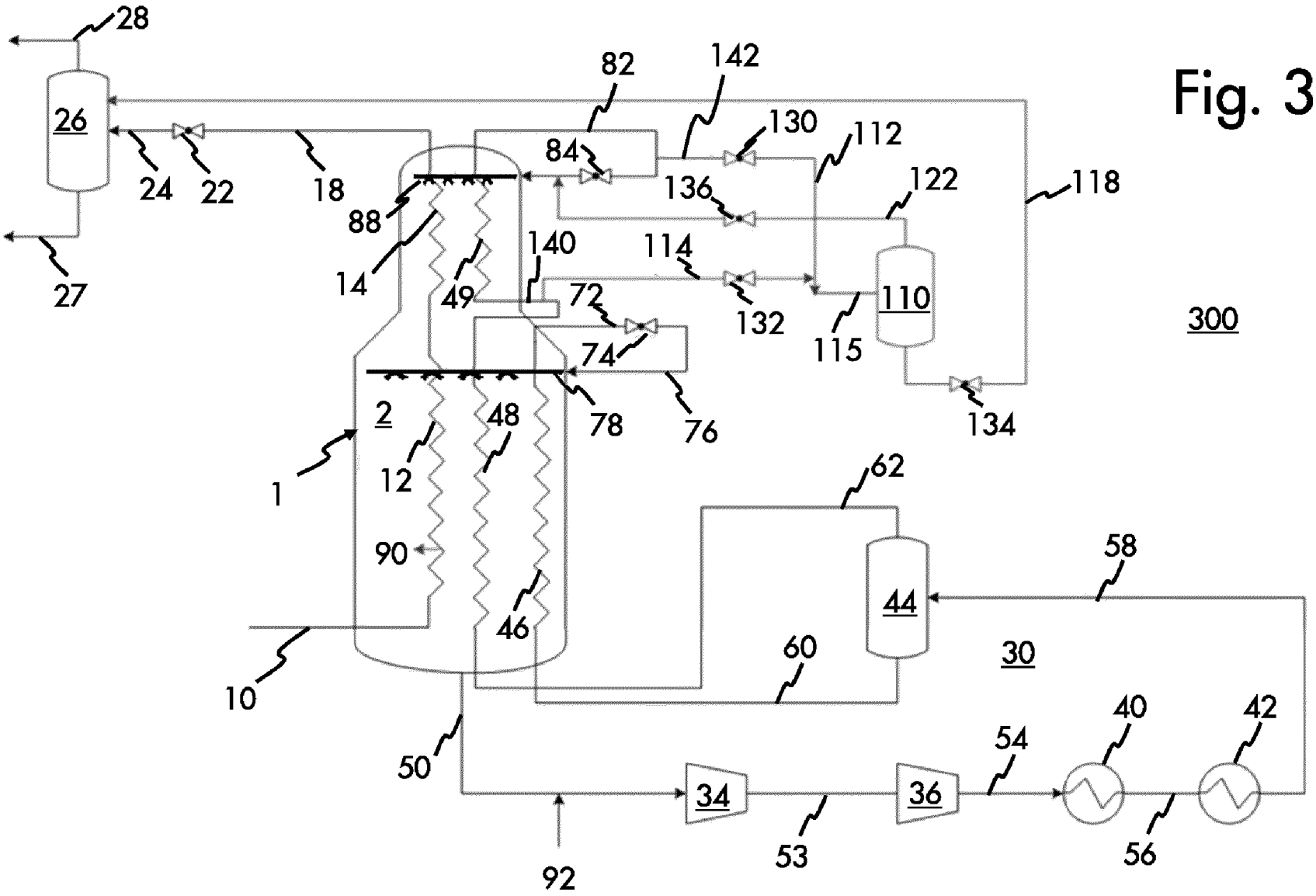
FIG. 3 schematically depicts yet another embodiment of a main cryogenic heat exchanger according to the present disclosure.

The second split-off stream 114 may originate from the plurality of refrigerant tubes 46, 48, 49. Herein, the second split-off stream 114 may originate from a location between one or more of the inlets 70, 80 via which the refrigerant tubes 46, 48, 49 receive part of the pre-cooled mixed refrigerant stream 58 and one or more outlets via which the plurality of refrigerant tubes discharge the cooled mixed refrigerant streams 72, 82. In a practical embodiment, the second split-off stream 114 originates from an intermediate section or middle section 140 of the second refrigerant tubes 48, 49, typically between the refrigerant tubes 48 and the refrigerant tubes 49. Said middle section 140 is for instance located above the first spray headers 78. The middle section above at or near the first vertical level of the cooled heavy mixed refrigerant stream 72 (FIG. 3).

In use, the first split-off stream 112 has a first temperature and a first pressure. The second split-off stream 114 is taken from a different position than the first split-off stream 112, to ensure that, in use, the second split-off stream 114 has a higher (second) temperature than the (first) temperature of the first split-off stream 112. In a practical embodiment, the second temperature exceeds the first temperature by at least 10° C., preferably at least 20° C.

By providing a mixed refrigerant bleed vessel 110 being fluidly connected to the mixed refrigerant loop 30 via at least two different split-off streams, each being connected to the refrigerant circuit 30 at different split-off positions, and each having different temperature, the conditions in the mixed refrigerant bleed vessel 110 can be controlled relatively acurately. For instance, the temperature of the mixed split-off stream 115 in relation to pressure can be controlled relatively acurately. This accurate control widens the operating window, allowing to limit the amount of required make-up refrigerant 92 within predetermined specifications.

Said specifications are typically determined by availability of one or more components of the mixed refrigerant.

The conditions can be controlled, for instance, by adjusting the ratio of the flow rate of the first split-off stream with respect to the second split-off stream. Herein, the composition of the bleed stream 118 can be controlled, to minimize loss of the most constrained mixed refrigerant component, typically ethane or nitrogen. In case of an ethane constraint, the conditions in the mixed refrigerant bleed vessel 110 may be controlled to obtain an ethane depleted bleed stream 118 and an ethane enriched recycle stream 122. In case of a nitrogen constraint, the conditions in the mixed refrigerant bleed vessel 110 may be controlled to obtain a nitrogen depleted bleed stream 118 and a nitrogen enriched recycle stream 122. The terms enriched and depleted are used relative to each other.

The pressure in vessel 110 for a given flow ratio of first split-off stream 112 with respect to second split off stream 114 can be controlled, for instance by controlling vapor outlet valve 134 of the vessel 110. The pressure in vessel 110 can be controlled depending on the composition of the mixed refrigerant in the MR circuit 30. For a given temperature in the bleed vessel 110, the bleed vessel pressure is typically maintained above a threshold pressure level exceeding the pressure in the heat exchanger vessel 2, for instance by at least 3 to 8 barg. This may apply to all embodiments.

Potential alternative options for bleed locations of the mixed refrigerant circuit 30 are, for instance:

1. A discharge bleed stream from an outlet of the low pressure mixed refrigerant compressor 34 to a low-pressure fuel gas system (not shown). The bleed stream may be a split-off stream from, for instance, stream 53. This bleed stream can be remotely operated and controlled. However, selective removal of methane is difficult or even impossible to achieve.

Figure 5:
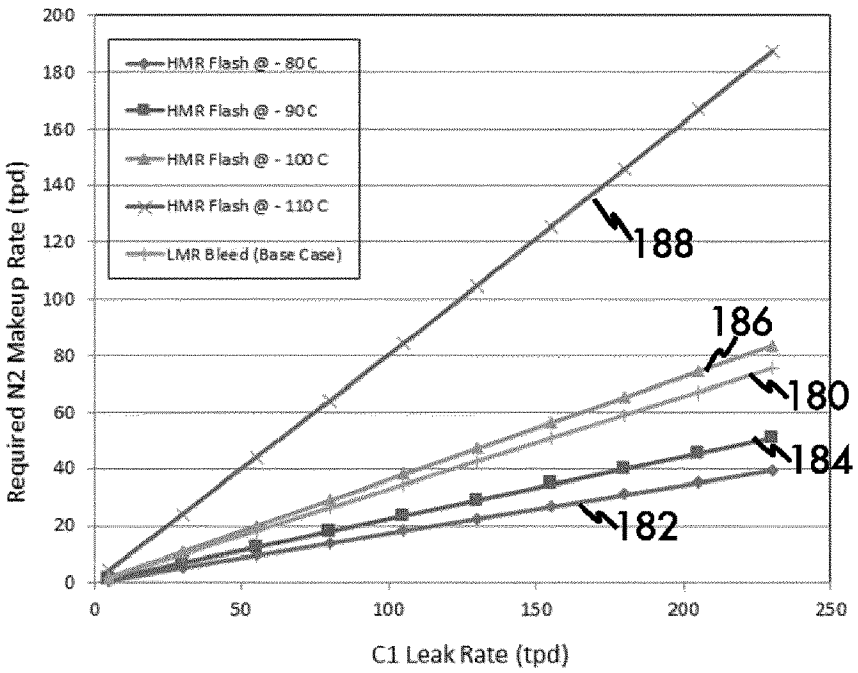
FIG. 5 shows an examplary diagram indicating the relation between a methane leak rate (x-axis) and a required nitrogen make-up rate (y-axis).
Figure 4:
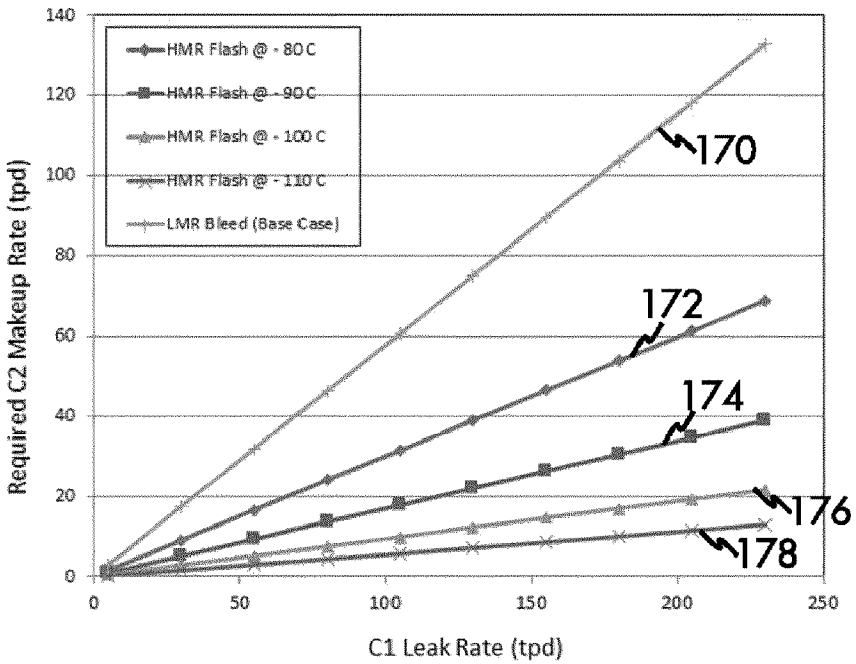
FIG. 4 shows an examplary diagram indicating the relation between a methane leak rate (x-axis) and a required ethane make-up rate (y-axis)

2. A remotely operated split-off stream from stream 62, liquefied by heat transfer against stream 28, in an End Flash vessel or LMR cold recovery heat exchanger and mostly recovered as LNG. (This option is not shown; vessel and/or heat exchanger referred to can be an additional flash or cold recovery heat exchanger introduced in, for instance, LMR stream 82). This is a typical location for a significant leak rate as the LMR bleed stream can be recovered as LNG (comparable to stream 27) and/or end flash or fuel gas (comparable to stream 118 in FIG. 3). This option may result in a balanced demand on ethane and nitrogen. The embodiments described with respect to FIGS. 1 to 3 however can significantly reduce the demand for make-up ethane and/or nitrogen with respect to this option 2, as illustrated in FIGS. 4 & 5. Herein, the base case may correspond to conventional practice of bleeding LMR from the MR circuit. Also, the embodiments of the present disclosure reduce capital expenditure, as the bleed vessel 110 and the associated control valves can typically be relatively small (as described in the remainder of the disclosure).

3. A remotely operated LMR bleed the high-pressure MR separator 44, i.e. a split-off stream from LMR stream 62. This can be a good option where option 2 is impossible. For instance, methane content of the bleed stream can be in the order of 50 to 55 mol %, resulting in collateral and unwanted bleed of nitrogen in the range of 10 to 20 mol % and ethane in the range of 10 to 25 mol %. However, in this case the bleed is typically flared, i.e., lost. In addition, demand for make-up ethane and/or nitrogen for this option is much higher when compared to the embodiments of the present disclosure.

4. Manually operated side vents (not shown) of the MCHE vessel 2. Herein, a typical DN50 MCHE cold bundle shroud vent can be the most effective (a shroud vent is a vent typically included in a MCHE vessel 2 as marketed by vendors such as Linde or Air Products (APCI)). Bleeding MR using the shroud vent requires significant manual intervention. In addition, the MCHE temperature profile is affected if the vent stream flow is substantially increased through the shroud vent, to manage higher NG leak rates, thereby negatively affecting the operability of the LNG train and LNG production.

5. A remotely operated MCHE shell 2 cold bundle vent valve (not shown). This is typically a large process control valve (PCV) arranged at the top of the MCHE vessel 2. This option is recommended only when the site is ethane constrained. Opening of the PCV for bleeding typically results in significant loss of nitrogen from the MR circuit 30 and requires corresponding make-up. For instance, the bleed stream can comprise in the order of 30 to 40 mol % nitrogen in addition to methane. In addition, this option usually causes a temperature pinch at the top of the MCHE cold bundle (tubes 14, 49) and therefore, a relatively large disruption of the setting of the MR circuit 30. The latter typically negatively impacts LNG production and thus revenue.

In an embodiment of the present disclosure (FIGS. 1, 2), the HMR stream 72 from the MCHE mid bundle is conditioned in terms of temperature (by blending with warmer HMR 60 from the MR separator 44). The pressure in vessel 110 can be controlled using, for instance, a valve on the vapor outlet of the vessel 110, such as valve 134. Control of temperature and pressure is done prior to bleeding the bleed stream 118 to, for instance, the end flash vessel 26 for recovery as LNG (stream 27) or as fuel gas (stream 28).

The bleed separator 110 and its related control valves 130-136 of the present disclosure can be mounted on a skid, as a complete assembly. The skid mounted bleed assembly thus can be connected to an existing LNG train, as indicated in—for instance—one of FIGS. 1 to 3. Thus, the assembly of the disclosure allows to extend the lifetime of an MCHE having leaking gas tubes up to a pre-scheduled turnaround. Preventing intermediate downtime and limiting downtime to scheduled maintenance periods only provides a major cost saving. After the turnaround period, the leaks in the gas tubes 12, 14 are typically fixed, so that the skidded bleed assembly (bleed separator 110 and its valves) can be removed.

Figure 2:
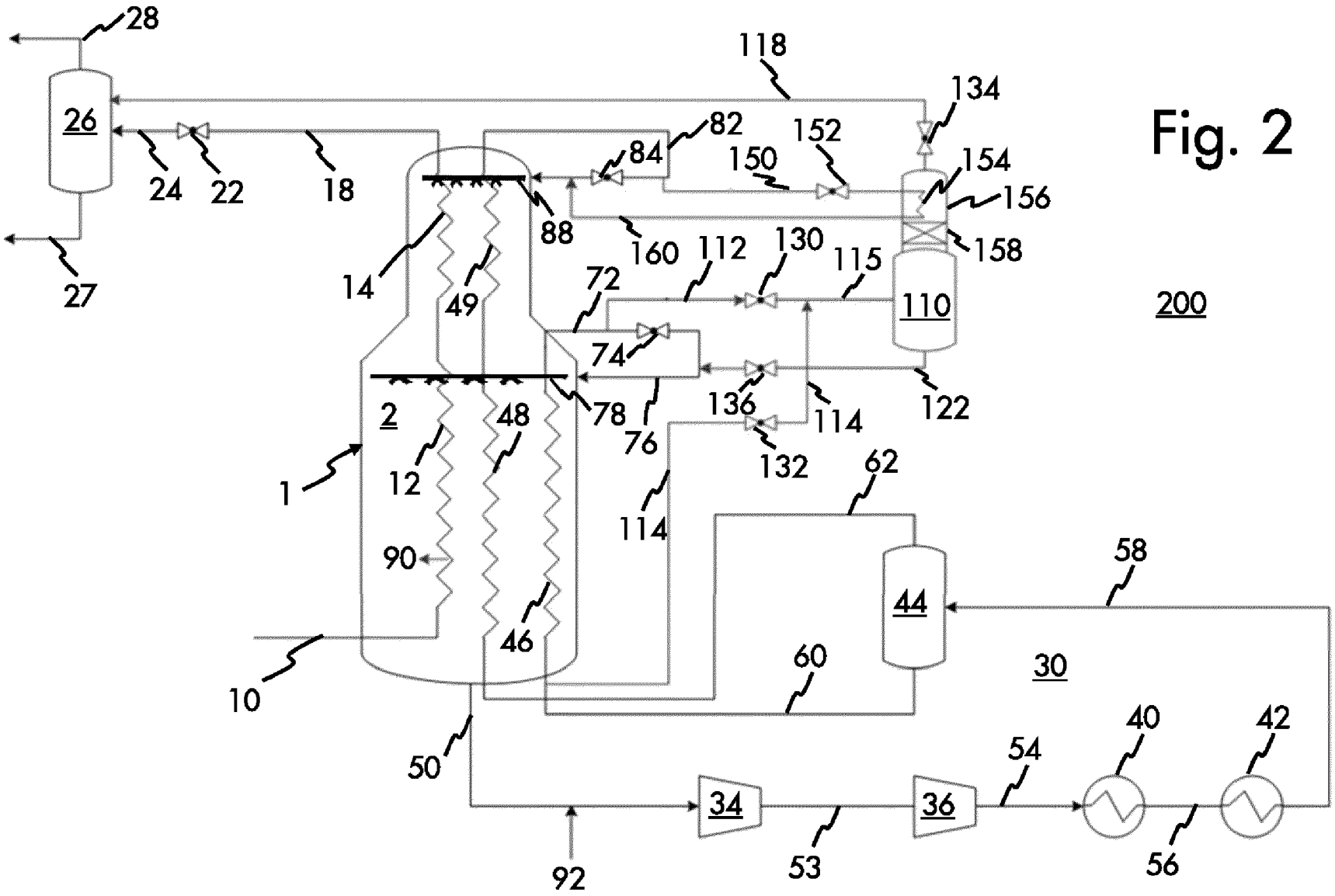
FIG. 2 schematically depicts another embodiment of a main cryogenic heat exchanger according to the present disclosure.

In a practical embodiment, MR stream 50 may have a temperature in the range of −30 to −45° C. and pressure in the range of 2 to 5 barg. MR stream 58 may have a temperature slightly lower than stream 50, for instance in the range of −25 to −40° C. Stream 58 may have a pressure in the range of about 35 to 50 barg. Cooled HMR stream 72 may have a temperature in the range of −110 to −130° C. and a pressure in the range of about 30 to 45 barg. Cooled LMR stream 82 may have a temperature in the range of about −130 to −160° C. and a pressure in the range of about 30 to 45 barg. The pressure of stream 72 and 82 is typically slightly lower than the pressure of stream 58 due to pressure loss in the pipes. Conditions inside the bleed separator 110 may be controlled to have a temperature in the range of about −80 to −120° C. and a pressure in the range of about 5 to 10 barg, for HMR bleed (FIGS. 1 and 2). Alternatively, conditions inside the bleed separator 110 may be controlled to have a temperature in the range of about −130 to −160° C. and a pressure in the range of about 5 to 10 barg, for LMR bleed (FIG. 3). For a combined bleed of LMR and HMR (not shown), conditions in the bleed separator 110 may be an average of the latter values.

In a practical embodiment, composition of the MR at various locations in the MR circuit 30 may be as follows. Pressurized pre-cooled MR stream 58 may comprise, at least, about 3 to 8 mol % N2 (i.e. nitrogen), 40 to 45 mol % C1 (i.e. methane), 35 to 45 mol % C2 (i.e. ethane), and/or 5 to 15 mol % C3 (i.e. propane). Pre-cooled HMR stream 60 may comprise, at least, about 1 to 3 mol % N2, 30 to 35 mol % C1, 45 to 55 mol % C2, and/or 15 to 20 mol % C3. Bleed stream 118 may comprise, at least, about 5 to 15 mol % N2, 80 to 90 mol % C1, 5 to 10 mol % C2, and/or an insignificant amount of C3 (C3 less than 0.3 mol %). Bleed stream 118 may have a temperature of about −85 to −120° C. and/or a pressure in the range of about 5 to 10 barg.

The embodiments of the present disclosure thus allow significantly increased selectivity to bleed methane from the refrigerant circuit 30. For instance, a typical conventional bleed from the pre-cooled HMR stream 62 may comprise in the order of 50 to 55 mol % methane, and thus also 45 to 50 mol % of other components such as ethane and propane. The cooled HMR bleed shown in FIGS. 1 and 2 allows the bleed stream 118 to have a methane content exceeding 80 mol %. Tests have indicated that methane selectivity may be, for instance, between 80 to about 85% or more. The selectivity can exceed 85% if the MR itself has a higher methane content than used for the tests and associated calculations (N2: about 5.5 mol %; C1: about 43 mol %; remainder C2 about 40 mol %). The embodiment using a cooled LMR bleed shown in FIG. 3 allows the bleed stream 118 to have an improved methane selectivity, with methane content exceeding 85 mol % for the test scenario.

The pressure in the vessel 110 may be controlled by the valve in the vapor stream of the vessel (In the embodiments of FIGS. 1 and 2, this would be valve 134. In the embodiment of FIG. 3, this would be valve 136). The fluid level in the vessel 110 may be controlled by the valve in the liquid stream of the vessel (In the embodiments of FIGS. 1 and 2, this would be valve 136. In the embodiment of FIG. 3, this would be valve 134). The latter may avoid mixing vapor and liquid streams of different composition. The temperature of the vessel 110 may be controlled by pressure let down and manipulating the blend ratio of the cold splitoff streams (streams 112, 142) and warmer splitoff stream (114) using valves 130 and 132 respectively.

In addition to significantly increased selectively for methane in the bleed stream, the system and method of the present disclosure improve process safety and control. The system can be skid mounted with valves having suitable sizes and allowing effective control. The skid mounted system allows to minimize equipment count and capital expenditure, as a single system can be used to mitigate gas leaks in the various heat exchangers in multiple LNG trains.

The approach of using an external seperator 110 to condition the mixed refrigerant stream can be applied for any mixed refrigerant circuit with any heat exchanger type that is susceptible to NG leaks. Such heat exchanger type may include, but is not limited to, a coil wound heat exchanger, a brazed aluminium heat exchanger, a plat frame heat exchager, and a printed circuit heat exchanger. In the description of exemplary embodiments above, any reference which may be construed as limited to a particular type of heat exchanger can equally be applied to other types of heat exchangers. For instance, references to gas tubes or coils and/or refrigerant tubes or coils may be construed more generally as respective conduits for indirect heat exchange of a process stream (such as natural gas) with respect to one or more refrigerant streams.

EXAMPLES

Conventionally, in an LNG processing facility having a significant number (for instance three or more) of LNG trains (having a typical NGL extraction unit) and processing a reasonably rich feed gas (for instance natural gas producing LNG having higher heating value (HHV) >1120 Btu/scf (about 1.2 TW*s/2.9 Ws)), experience has shown that only a single significant gas tube leak inside the MCHE vessel (MCHE NG leak rate >about 50 tonne per day [tpd] (about 0.58 kg/s)) could be accommodated effectively without causing a slowdown in the other LNG trains. If there is a concurrent MCHE gas tube leak in another train, i.e. if there are two or more gas leaks at the same time, then the demand on, for instance, ethane exceeds the available supply of ethane for refrigerant make-up and will therefore result in a slowdown of and decrease in overal LNG production. Also, the operational flexibility, especially the ability to shutdown and/or start-up of LNG trains, is affected.

To assess the effectiveness of embodiments of the system and method of the present disclosure compared to conventional refrigerant bleed schemes, process simulations were conducted. For instance, for a typical MR composition for an LNG process provided with an end flash system 26 (MR composition is, for instance, in the order of: N2: about 5.5 mol %; C1: about 43 mol %; C2: about 39.5 mol %; C3: about 12 mol %) and MR circulation rates (about 290 kg/s). In the simulations, the MR circuit bleed stream flow at various locations were adjusted to ensure the total molar flowrate of methane entering the refrigerant circuit via the natural gas tube leaks (schematically indicated by stream 90) is substantially similar as those leaving with the bleed stream. The consequential loss of MR components other than methane is made-up (make-up stream 92), to ensure a substantially constant MR composition. In practice, the actual make-up of refrigerant components is expected to be higher than estimated in the simulations, for instance due to an error margin in the estimated NG leak rate.

FIGS. 4 and 5 provide exemplary diagrams of an ethane and nitrogen make-up rate (y-axis; in tonne per day) respectively as function of the natural gas tube circuit leak rate (x-axis; in tonne per day), for various temperatures in the separator 110. These temperatures may be referred to as heavy mixed refrigerant flash conditions. The temperatures ranges, for instance, from −80° C. to −110° C.

FIGS. 4 and 5 show a base case 170, 180 respectively. Said base case relates to an LMR stream bleed (to flare or end flash vessel; for instance, comparable to options 2 to 3 described above). Lines 172 to 178 indicate a required ethane (C2) make-up rate (in tpd) for separator 110 temperatures of −80° C., −90° C., −100° C. to −110° C. respectively. These temperatures substantially correspond to the temperature of mixed bleed stream 115. Lines 182 to 188 indicate a required nitrogen (N2) make-up rate (in tpd) for separator 110 temperatures of −80° C., −90° C., −100° C. to −110° C. respectively.

FIGS. 4 and 5 show that, for instance, at an HMR separator 110 temperature of approximately −90° C., the ethane make-up demand is more than 300% lower, for the same NG tube leak rate, than the base case. Also, the N2 make-up rate can be substantially lower than the base case. Depending on availability of respective refrigerant components, the temperature in the HMR separator 110 can be adjusted (by second split-off stream 114) to favor either N2 or C2, increasing the respective saving.

Simulations of the proposed embodiment of FIG. 1 described above indicate the potential to reduce ethane consumption by up to about 600% and/or to reduce nitrogen consumption by up to about 50%. Alternatively, with a given ethane production capacity at an LNG production facility, a higher natural gas leak rate can be sustained. For instance, a gas leak rate (stream 90) up to 600% above the maximum allowable gas leak rate of a conventional LNG facility can be sustained without significant loss of LNG production or shutdown. Also, the bleed stream can be recovered as useful product (typically as fuel gas or LNG) instead of flaring due to the ability to control its pressure and temperature.

For example, for a conventional LNG facility having an average daily ethane production rate of about 50 tpd [about 0.6 kg/s] and for a typical daily average refrigerant consumption rate, in a conventional setting MCHE gas tube leaks (stream 90) of up to about 25 tpd [about 0.3 kg/s] could be sustained without a shutdown or slowdown. For an LNG train having an external HMR and LMR separator at the mid and/or cold bundle (tubes 49) respectively (enabling additional bleed locations), leak rates of 100 tpd [about 1.2 kg/s] or more could be sustained, without significantly affecting ethane supply to other LNG trains.

For the study case, the feed to the bleed separator 110 for an NG leak rate of about 100 tpd [about 1.2 kg/s] is about 1200 tpd [about 14 kg/s] (Vessel 2 having a diameter of approximately 0.6 m), in comparison to the HMR circulation rate (stream 60) of approximately 18,000 tpd [208 kg/s]. This can be sustained having a bleed stream 118 having bleed flow rate of about 1.5 to 2 kg/s and a composition as in practical embodiments described above. Flow rates of components of make-up stream 92 can be, for instance, in the range of 0 kg/s C1, 0.1 to 0.3 kg/s C2, 5 to 15 g/s C3, and/or 0.2 to 0.4 kg/s nitrogen.

The frequency of MCHE leaks from practical experience indicates the relevance of the embodiments of the present disclosure. For instance, in the order of 4 MCHE repairs were required per LNG train over a 10-year period. Repair of a leak takes typically about 7 engineering days.

Additional possibilities exist to minimize bleed rate. For instance, if the LNG site is nitrogen constrained instead of ethane, the liquid LMR bleed stream 142 (FIG. 3) can be connected to the same separator 110. Herein, streams 142 and stream 113 may be combined to form first split-off stream 112. From separator 110, a nitrogen rich vapour stream can be returned to the MCHE vessel 2 while a methane rich liquid stream can be routed to end flash vessel 26 for recovery as LNG (FIG. 3).

Alternatively, one may consider providing a vapour bleed location directly from the pressurized HMR liquid distributor 44.

In general, the system and method of the present disclosure can be applied to any heat exchanger in a mixed refrigerant circuit. For example, a mixed refrigerant process may include a precooling circuit as well as a main cooling circuit, both cooling circuits comprising one or more heat exchangers. A similar approach as described in the present disclosure can be applied to all heat exchangers in a liquefaction process carrying both mixed refrigerant and a gas stream to be liquefied to mitigate gas leaks from the gas circuit to the refrigerant circuit. Examples of mixed refrigerant processes include, for instance, a single mixed refrigerant process (see for instance U.S. Pat. No. 6,658,891), a dual mixed refrigerant process (see for instance U.S. Pat. No. 6,370,910), a parallel mixed refrigerant process (see for instance US20080156037), or a C3MR process (see for instance US20090301131).

The present disclosure is not limited to the embodiments as described above and in the appended claims. Many modifications are conceivable therein and features of respective embodiments may be combined.

That I claim:

1. A heat exchanger unit for cooling a gaseous process stream, the heat exchanger unit comprises:

a heat exchanger vessel comprising a plurality of process stream conduits arranged to receive the gaseous process stream and to discharge a cooled process stream, a first and second refrigerant inlets connected to a plurality of refrigerant conduits to receive at least part of a pre-cooled mixed refrigerant stream to provide cooling to the process stream conduits and discharge a cooled mixed refrigerant stream;

an expansion device arranged to receive at least part of the cooled mixed refrigerant stream and discharge a further cooled mixed refrigerant stream to at least one of a third refrigerant inlet and a fourth refrigerant inlet of the heat exchanger vessel to provide cooling to the process stream conduits and the plurality of refrigerant conduits;

a refrigerant bleed vessel arranged to receive a first refrigerant split-off stream split off from the cooled mixed refrigerant stream upstream to the expansion device and to receive a second refrigerant split-off stream split off from the pre-cooled mixed refrigerant stream upstream to the first or second refrigerant inlet;

wherein the refrigerant bleed vessel comprises a bleed outlet to discharge a bleed stream and a recycle outlet to discharge a recycle stream, the recycle outlet being fluidly connected to at least one of the third refrigerant inlet and the fourth refrigerant inlet of the heat exchanger vessel.

2. The heat exchanger unit of claim 1, wherein the plurality of refrigerant conduits comprising first refrigerant conduits and second refrigerant conduits, the heat exchanger unit comprising a refrigerant separator arranged to receive the pre-cooled mixed refrigerant stream and to provide a pre-cooled heavy mixed refrigerant stream and a pre-cooled light mixed refrigerant stream, the first refrigerant conduits being fluidly connected to a first outlet of the separator to receive the pre-cooled heavy mixed refrigerant stream and to provide a cooled heavy mixed refrigerant stream, and the second refrigerant conduits being fluidly connected to a second outlet of the refrigerant separator to receive the pre-cooled light mixed refrigerant stream and to provide a cooled light mixed refrigerant stream.

3. The heat exchanger unit of claim 2, wherein the second refrigerant split-off stream being connected to a refrigerant loop downstream of the refrigerant separator.

4. The heat exchanger unit of claim 3, wherein the second refrigerant split-off stream being connected to the refrigerant loop upstream of the first or second refrigerant inlet.

5. The heat exchanger unit of claim 2, wherein the second refrigerant split off stream originating from an intermediate section of the second refrigerant conduits.

6. The heat exchanger unit of claim 2, wherein the first refrigerant split-off stream being connected to the cooled heavy mixed refrigerant stream.

7. The heat exchanger unit of claim 1, further comprising:

a first control valve to control a mass flow rate of the first refrigerant split-off stream, and a second control valve to control a mass flow rate of the second refrigerant split-off stream.

8. The heat exchanger unit of claim 7 further comprising:

a third control valve to control one or more of pressure in the refrigerant bleed vessel and/or mass flow rate of the bleed stream.

9. The heat exchanger unit of claim 8 further comprising;

a fourth control to control mass flow rate of the recycle stream.

10. A method for cooling a gaseous process stream, the method comprises the steps of:

providing a heat exchanger unit for cooling a gaseous process stream, wherein the heat exchanger unit comprises a heat exchanger vessel comprising a plurality of process stream conduits, and a first and second refrigerant inlets connected to a plurality of refrigerant conduits;

receiving the gaseous process stream in the plurality of process stream conduits and discharging a cooled process stream from the plurality of process stream conduits, receiving at least part of a pre-cooled mixed refrigerant stream in the plurality of refrigerant conduits and discharging a cooled mixed refrigerant stream from the plurality of refrigerant conduits;

receiving at least a portion of the cooled mixed refrigerant stream at an expansion device of the heat exchanger unit and discharging a further cooled mixed refrigerant stream from the expansion device, providing the further cooled mixed refrigerant stream to at least one of a third refrigerant inlet and a fourth refrigerant inlet of the heat exchanger vessel to provide cooling to the plurality of process stream conduits and to the plurality of refrigerant conduits;

receiving, by the refrigerant bleed vessel of the heat exchanger unit, a first refrigerant split-off stream split off from the cooled mixed refrigerant stream upstream to the expansion device, receiving, by the refrigerant bleed vessel, a second refrigerant split-off stream split off from the pre-cooled mixed refrigerant stream upstream to the first or second refrigerant inlet;

discharging a bleed stream from a bleed outlet of the refrigerant bleed vessel; and discharging a recycle stream from a recycle outlet of the refrigerant bleed vessel, the recycle outlet being fluidly connected to at least one of the third refrigerant inlet and the fourth refrigerant inlet of the heat exchanger vessel.

11. The method according to claim 10, wherein the step of receiving, by the refrigerant bleed vessel, the second refrigerant split-off stream comprises:

mixing the second refrigerant split-off stream with the first refrigerant split-off stream; and providing the mixture of the first refrigerant split-off stream and the second refrigerant split-off stream to the refrigerant bleed vessel.

12. The method according to claim 10, further comprising:

separating the pre-cooled mixed refrigerant stream into a pre-cooled heavy mixed refrigerant stream and a pre-cooled light mixed refrigerant stream, wherein the step of receiving at least part of the pre-cooled mixed refrigerant stream in the plurality of refrigerant conduits comprises;

receiving the pre-cooled heavy mixed refrigerant stream in first refrigerant conduits and discharging a cooled heavy mixed refrigerant stream, and receiving the pre-cooled light mixed refrigerant stream in second refrigerant conduits and discharging a cooled light mixed refrigerant stream.

13. The method according to claim 12 further comprising the step of:

obtaining the first refrigerant split-off stream from the cooled heavy mixed refrigerant stream.

14. The method according to claim 2 further comprising the step of obtaining the second refrigerant split-off stream from the pre-cooled heavy mixed refrigerant stream.

15. The method of claim 10 further comprising the step of:

controlling a temperature and/or pressure of the first refrigerant split-off stream by adjusting a second flow rate of the second refrigerant split-off stream relative to a first flow rate of the first refrigerant split-off stream.

16. The method according to claim 10, wherein the bleed stream is a vapor stream, the method further comprises the step of at least partially condensing the bleed stream using a condensing medium.

17. The method according to claim 16 further comprising the step of separating a condensing stream from the cooled light refrigerant stream and using the condensing stream as the condensing medium.

* * * * *